United States Patent [19]

Svensson

[11] 4,196,550

[45] Apr. 8, 1980

[54] POST

[76] Inventor: Lars Svensson, 112 Vikingavagen, Taby, Sweden, S-183 43

[21] Appl. No.: 849,925

[22] Filed: Nov. 9, 1977

[51] Int. Cl.[2] ..... E04C 1/00

[52] U.S. Cl. ..... 52/98; 29/163.5 R; 29/527.2; 404/10

[58] Field of Search ..... 52/98, 99, 727, 724, 52/725; 404/10; 405/43; 29/163.5, 527.2

[56] References Cited

U.S. PATENT DOCUMENTS

| | | | |
|---|---|---|---|
| 701,426 | 6/1902 | Tuttle | 52/725 |
| 724,744 | 4/1903 | Schratwieser | 52/725 |
| 3,853,418 | 12/1974 | Druin | 52/98 |
| 3,869,778 | 3/1975 | Yancey | 52/98 |
| 3,987,593 | 10/1976 | Svensson | 52/98 |

FOREIGN PATENT DOCUMENTS

| | | | |
|---|---|---|---|
| 2322081 | 12/1973 | Fed. Rep. of Germany | 52/98 |

*Primary Examiner*—James A. Leppink
*Assistant Examiner*—Henry E. Raduazo
*Attorney, Agent, or Firm*—Karl W. Flocks; Karl W. Flocks

[57] ABSTRACT

A post for traffic signs, electrical or telephone lines, lighting fittings and the like adapted to have minimum resistance when being hit by vehicles and the like, but sufficient stability under normal conditions, having a pipe with a series of intermittently arranged longitudinal, longish and scattered weakened slot-like portions and a covering layer enclosing the pipe and circumferentially stabilizing the pipe portions separated by the weakened portions.

5 Claims, 3 Drawing Figures

POST

The present invention relates to a post, designed preferably to support traffic signs, electric and telephone wires, light fittings and the like.

The increasing traffic along traffic-routes has resulted in an increasing number of accidents in the form of collisions with stationary objects, which often are posts of various types, such as those used to support road and traffic signs, signboards, electric and telephone wires and the like. It has therefore been desired to make a post, especially intended for road signs and the like, that is yieldingly deformable under the impact of a collision but still has the strength required to answer its primary purpose.

Collisions, even with those rather simple and weak posts used today to support e.g. road signs, generally cause severe and, especially, costly damages to the vehicle, even if they do not result in personal injuries, and the costs for repairing the vehicle damages are many times greater than the costs for replacement and mounting of a new post. The annual costs due to vehicle damages caused by collisions, with road sign posts and the like amount to considerable sums and it is an object of this invention to provide a new yieldable post in order essentially to reduce such vehicle damages and, consequently, the costs caused thereby.

The essential characteristic of the post of this invention is that it comprises a tube which has circumferentially spaced, weakened portions, in the form of slits, extending at intervals longitudinally of the tube and that the tube is provided with a surface layer which stabilizes the discrete portions of material between the slits to resist buckling, and produces a bridging effect therebetween.

Embodiments of the post of the invention will be described in greater detail hereinbelow with reference to the accompanying drawing, in which.

Common to both these embodiments is the feature that the slits 1 extend longitudinally and are arranged at intervals.

Figure 1:
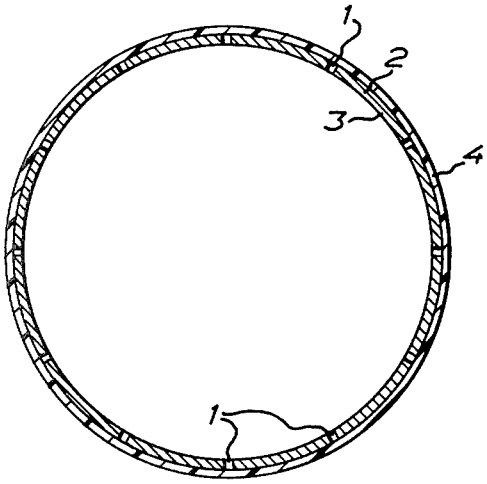
FIG. 1 is a cross-sectional view of an embodiment of the post.

In the embodiment of FIG. 1 the post consists of a tube 2 which is provided with circumferentially spaced slits 1 which extend at intervals longitudinally of the tube. To stabilize the portions of material 3 between the slits and to prevent outward buckling caused by normal bending moments, the tube is provided with an external shell 4 of slightly elastic material, e.g. plastic material, which adheres to the tube 2.

At the same time as the material of the shell prevents buckling, it has to transfer certain shearing stresses between the portions of material situated between the slits and to produce a certain bridging effect between said portions, which is important, for instance, when the post is subjected to such local point loading as may occur when climbing irons are applied to a telephone post designed in accordance with this invention.

However, when the post is subjected to a transverse force of the type produced when the post is being run into, then the discrete portions between the slits will act individually and produce an insignificant resistance to bending such that the pole will yield.

Figure 2:
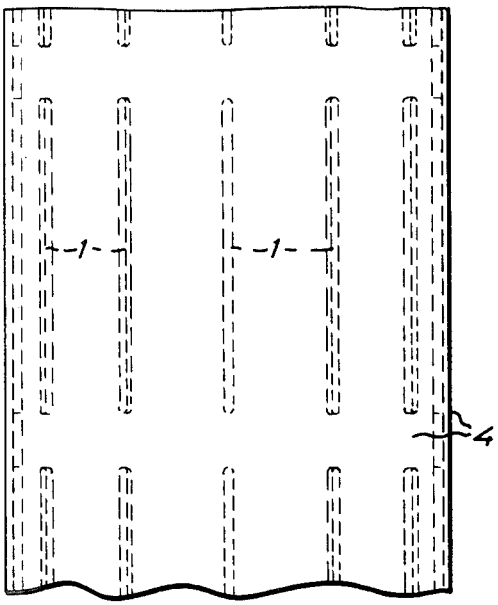
FIG. 2 is a side-elevational view of a section of the post.
Figure 3:
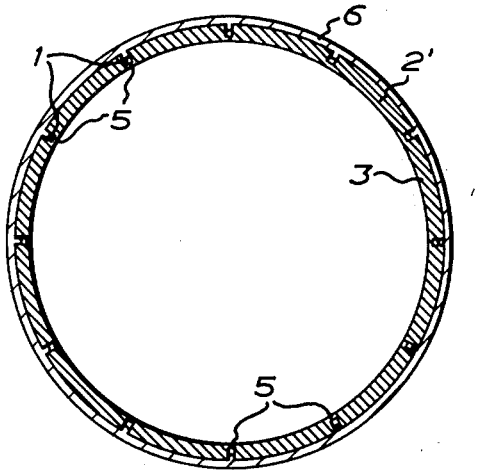
FIG. 3 is a cross-sectional view of another embodiment.

In the embodiment of FIG. 3 the post consists of a single tube 2' the material of which has been slit throughout or so much that just a thin material layer 5 is left at the bottom of the slits 1. There is no separate shell surrounding the tube 2' but the tube is provided with a surface layer 6 which is to stabilize the internal relation of the discrete portions of material between the slits, at the same time as it serves as a corrision protection.

The surface layer may consist of a galvanization which has been allowed to fill out, more or less completely, the slits 1 in the tube 2' made of steel. The zinc, or other metal used, produces a bridging effect of the above-mentioned type between said portions of material and it also is capable of preventing outward buckling of said portions resulting from normal bending stresses.

However, when subjected to a heavy transverse stress, the internal connection provided by the galvanic layer between the discrete portions of material situated between the slits will break and said portions will act individually.

The invention must not be considered limited to the embodiments described above and shown in the drawings but may be modified in various ways within the scope of the appended claims.

What I claim and desire to secure by Letters Patent is:

1. Post for supporting traffic signs, light fittings and the like, comprising a tubular member made of metal and having a number of circumferentially spaced longitudinally extending slits forming weakened portions of a mantle wall of the member along longitudinally spaced portions of its length, and a surface layer means affixed to said tubular member to bridge and stabilize said weakened portions of said mantle of the member separated by the slits, the length of said slits and the material of said stabilizing layer means being selected so that the material of said stabilizing layer means will prevent buckling of said weakened portions during normal loading but will allow breaking under point loading such as that produced by impact of a vehicle.

2. A post as claimed in claim 1, wherein said tubular member is a relatively thin-walled slitted steel tube having the slits extending through the wall material of said steel tube and wherein said surface layer means is a plastic material firmly affixed to the surface of said portions of said tubular member bridging the slits.

3. Post for supporting traffic signs, light fittings and the like, comprising a tubular member made of metal and having a number of circumferentially spaced longitudinally extending slits forming weakened portions of a mantle wall of the member along longitudinally spaced portions of its length, and a surface layer means affixed to said tubular member to stabilize said portions of said mantle wall of the member separated by the slits to prevent buckling of said portions by giving a bridging effect, said tubular member being a relatively thin-walled slitted steel tube, said surface layer means including metal attached to said steel tube by way of a galvanization type metal-applying process, said metal upon applying being allowed to at least partly fill out the slits.

4. A post as claimed in claim 3, wherein the slits go through said mantle wall of said tubular member.

5. A post as claimed in claim 3, wherein the slits are grooves and said applied metal of a thickness relatively small compared to the thickness of the wall of said steel tube remaines at the bottom of each slit.

* * * * *